US007874996B2

(12) United States Patent
Weinstein et al.

(10) Patent No.: US 7,874,996 B2
(45) Date of Patent: Jan. 25, 2011

(54) METHOD AND APPARATUS FOR MANIPULATING A TOE JOINT

(75) Inventors: Robert B. Weinstein, Atlanta, GA (US); Thomas P. Branch, Atlanta, GA (US); Fredrik Westin, Atlanta, GA (US); Alex Sattler, Marietta, GA (US)

(73) Assignee: ERMI Corporation, Decatur, GA (US)

( * ) Notice: Subject to any disclaimer, the term of this patent is extended or adjusted under 35 U.S.C. 154(b) by 937 days.

(21) Appl. No.: 11/218,731

(22) Filed: Sep. 2, 2005

(65) Prior Publication Data

US 2006/0116619 A1 Jun. 1, 2006

Related U.S. Application Data

(60) Provisional application No. 60/607,135, filed on Sep. 2, 2004.

(51) Int. Cl.
*A61H 1/02* (2006.01)

(52) U.S. Cl. ..... 601/27; 601/32

(58) Field of Classification Search ..... 601/5, 601/22, 29–33, 52, 23, 27, 28, 40; 482/79; 602/13, 27, 30–32; 69/27; 128/882
See application file for complete search history.

(56) References Cited

U.S. PATENT DOCUMENTS

| | | | | |
|---|---|---|---|---|
| 1,978,244 | A * | 10/1934 | Bach | 601/27 |
| 2,002,586 | A * | 5/1935 | Ryberg, Jr. | 601/21 |
| 2,230,890 | A * | 2/1941 | McClenathen | 601/122 |
| 2,250,493 | A * | 7/1941 | Milne | 601/27 |
| 2,255,066 | A * | 9/1941 | Lamb | 601/29 |
| 2,397,428 | A * | 3/1946 | Moshier | 601/27 |
| 3,581,740 | A | 6/1971 | Sherbourne | |
| 3,780,728 | A | 12/1973 | Stader | |
| 3,906,942 | A | 9/1975 | Lumb, Jr. et al. | |
| 3,937,215 | A | 2/1976 | Barthlome | |
| 4,146,021 | A | 3/1979 | Brosseau et al. | |
| 4,291,715 | A | 9/1981 | Monte | |
| 4,608,988 | A * | 9/1986 | Dananberg | 36/140 |
| 4,671,258 | A | 6/1987 | Barthlome | |
| 4,756,096 | A * | 7/1988 | Meyer | 36/44 |
| 4,807,606 | A | 2/1989 | Hasegawa et al. | |

(Continued)

OTHER PUBLICATIONS

File history of U.S. Appl. No. 10/720,023, filed Nov. 19, 2003, entitled, "Orthotic Apparatus and Method for Using Same", Branch.

(Continued)

*Primary Examiner*—Danton DeMille
(74) *Attorney, Agent, or Firm*—Alston & Bird LLP

(57) ABSTRACT

Embodiments of the present invention are generally related to the manipulation of a joint to provide therapy. More specifically, some embodiments of the present invention use inflatable members and a three point bending concept to cause flexion in a toe joint for the purpose of increasing the range of motion of the toe joint. In one embodiment, a user's foot is placed in a frame with at least one toe atop a toe bar. An inflatable member is positioned atop the user's foot and held in position with a strap attached relative to the frame. As the inflatable member is inflated, the strap increases in tension urging the toe toward the toe bar and causing actuation of the joint at the base of the toe.

45 Claims, 10 Drawing Sheets

U.S. PATENT DOCUMENTS

| | | | | | |
|---|---|---|---|---|---|
| 4,862,875 | A | * | 9/1989 | Heaton | 601/26 |
| 5,020,515 | A | | 6/1991 | Mann et al. | |
| 5,056,504 | A | | 10/1991 | Mann | |
| 5,094,226 | A | * | 3/1992 | Medcalf et al. | 601/32 |
| 5,203,321 | A | * | 4/1993 | Donovan et al. | 601/5 |
| 5,211,161 | A | * | 5/1993 | Stef | 601/5 |
| 5,215,508 | A | * | 6/1993 | Bastow | 482/79 |
| 5,219,324 | A | | 6/1993 | Hall | |
| 5,297,540 | A | * | 3/1994 | Kaiser et al. | 601/27 |
| 5,348,530 | A | | 9/1994 | Grim et al. | |
| 5,378,224 | A | | 1/1995 | Billotti | |
| 5,453,082 | A | | 9/1995 | Lamont | |
| 5,514,081 | A | | 5/1996 | Mann | |
| 5,542,911 | A | | 8/1996 | Cassford et al. | |
| 5,702,354 | A | * | 12/1997 | DeSpain et al. | 601/27 |
| 5,730,710 | A | | 3/1998 | Eichhorn et al. | |
| 6,010,468 | A | * | 1/2000 | Grove et al. | 601/23 |
| 6,077,203 | A | * | 6/2000 | Lay | 482/79 |
| 6,238,357 | B1 | | 5/2001 | Kawaguchi et al. | |
| 6,589,194 | B1 | | 7/2003 | Calderon et al. | |
| 6,669,660 | B2 | | 12/2003 | Branch | |
| 6,702,768 | B2 | * | 3/2004 | Mano et al. | 601/29 |
| 2001/0018565 | A1 | * | 8/2001 | Branch | 602/13 |

OTHER PUBLICATIONS

Office Action dated Sep. 28, 2001 from U.S. Appl. No. 09/779,329, filed Feb. 8, 2001, entitled "Orthotic Apparatus and Method for Using Same", Branch.

Amendment to Official Action dated Sep. 28, 2001, from U.S. Appl. No. 09/779,329 with a mailing date of Jan. 28, 2002.

Office Action dated Nov. 20, 2002 from U.S. Appl. No. 09/779,329, filed Feb. 8, 2001, entitled "Orthotic Apparatus and Method for Using Same", Branch.

Amendment to Official Action dated Nov. 20, 2002, from U.S. Appl. No. 09/779,329 with a mailing date of Apr. 21, 2003.

* cited by examiner

METHOD AND APPARATUS FOR MANIPULATING A TOE JOINT

CROSS-REFERENCE TO RELATED APPLICATIONS

This application claims the benefit and priority of U.S. Application No. 60/607,135, filed Sep. 2, 2004, which is hereby incorporated herein in its entirety by reference.

BACKGROUND OF THE INVENTION

1. Field of the Invention

Embodiments of the present invention are generally related to the manipulation of a joint to provide therapy. More specifically, some embodiments of the present invention use inflatable members and a three point bending concept to cause flexion in a toe joint for the purpose of increasing the range of motion of the toe joint.

2. Background of the Invention

A common problem that afflicts the big toe or hallux is "hallux limitus" which is generally defined as a reduction in the normal range of motion of the first metatarsophalangeal joint. The normal range of motion of the metatarsophalangeal in dorsiflexion is approximately sixty-five degrees or alternatively the minimum amount of motion at the first metatarsophalangeal joint that does not cause an alteration of gait. Typically, a hallux limitus condition presents itself as pain or stiffness in the big toe during use such as walking, standing and bending or in some cases when not in use. Swelling and inflammation may also occur around the joint. Without proper treatment, hallux limitus can develop into hallux rigidus which is characterized by virtually no movement of the joint.

Several causes have been identified for hallux limitus. These causes include arthritis both traumatic and systemic, a long first metatarsal bone and an elevated first metatarsal bone. In each case the normal range of motion of the joint at the base of the big toe is restricted.

One non-surgical technique used to treat hallux limitus is physical therapy. However, physical therapy has shown inconsistent results because the exercises and equipment used do not reproduce the proper biomechanics of the toe joint. Accordingly, a need exists for non-surgical devices and methods of use that reproduce the proper biomechanics of the toe joint to improve the range of motion of the joint.

BRIEF SUMMARY OF THE INVENTION

The present invention overcomes deficiencies in the prior state of the art by providing an improved orthotic device.

In one embodiment of the present invention, an apparatus for manipulating a toe joint of a user having a lower leg, an ankle, a foot, a heel and a plurality of toes is provided. The apparatus comprising an elongage frame assembly which itself includes a heel plate and a toe bar, the heel plate being substantially parallel to the elongate axis of the frame assembly and configured to support the heel and the toe bar configured to support at least one of the plurality of toes. The apparatus further comprises a strap attached relative to the frame assembly intermediate the heel plate and the toe bar, an inflatable member attached to the strap. The strap is configured to position the inflatable member atop the foot such that when the inflatable member is inflated, the strap increases in tension urging the toe against the toe bar thereby causing the foot to move in plantarflexion and the toe to move in dorsiflexion.

In another aspect of the present invention, an apparatus for manipulating a toe joint of a user having a lower leg, an ankle, a foot, a heel and a plurality of toes is provided. The apparatus comprises: a frame assembly including a first frame rail and a second frame rail spaced apart and substantially parallel to the first frame rail, the frame assembly having a first end and a second end; a toe support bar pivotably attached to the first and the second frame rails proximate the first end of the frame assembly; a strap attached relative to the frame assembly intermediate the toe bar and the second end; and an inflatable member attached to the strap. The strap is configured to position the inflatable member atop the foot such that when the inflatable member is inflated, the strap increases in tension urging the toe against the toe bar, thereby causing the foot to move in plantarflexion and the toe to move in dorsiflexion.

In a further embodiment of the present invention, a method of manipulating a toe joint of a user having a lower leg, an ankle, a foot, a heel and a plurality of toes is provided. The method comprises the steps of: providing a frame assembly comprising a pair of elongate rails spaced apart and substantially parallel and connected proximate a first end by a toe bar; positioning a user's foot intermediate the pair of elongate rails with at least one of the plurality of toes positioned atop the toe bar; positioning an inflatable member atop the foot intermediate the plurality of toes and the ankle; securing the inflatable member to the frame assembly using a strap such that the inflatable member is intermediate the foot and the strap; and inflating the inflatable member such that the strap increases in tension thereby urging the toe against the toe bar causing the foot to move in plantarflexion and the at least one toe to move in dorsiflexion.

In another embodiment of the present invention, an apparatus for manipulating a toe joint of a user having a lower leg, an ankle, a heel, a foot and a plurality of toes is provided. The apparatus comprises: a heel containment device configured to restrict movement of the foot in an axis parallel to the longitudinal axis of the foot and in an axis parallel to the longitudinal axis of the leg; a pivoting toe bar attached relative to the heel containment device and configured to contact at least one of the plurality of toes; and a force application device configured to apply a force to the foot intermediate the heel and the plurality of toes in an axis substantially perpendicular to the longitudinal axis of the foot such that when the force is applied, the toe is urged toward the toe bar urging actuation of a joint intermediate the at least one toe and the foot.

In yet another embodiment, an apparatus for manipulating a toe joint of a user having a lower leg, an ankle, a foot, a heel and a plurality of toes is provided. The apparatus comprises: a frame assembly including a first frame rail and a second frame rail spaced apart and substantially parallel to the first frame rail, the frame assembly having a first end and a second end; a toe bar pivotably attached to the first and the second frame rails proximate the first end of the frame assembly and configured to be positioned on top of at least one of the plurality of toes; and an inflatable member attached relative to the frame intermediate the first and the second frame rails and also intermediate the toe support bar and the second end, the inflatable member configured to urge the at least one toe against the toe bar thereby causing the foot to move in dorsiflexion and the toe to move in plantarflexion.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

The present inventions now will be described more fully hereinafter with reference to the accompanying drawings, in which some, but not all embodiments of the invention are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Biomechanics of the Metatarsophalangeal Joint

Figure 1:
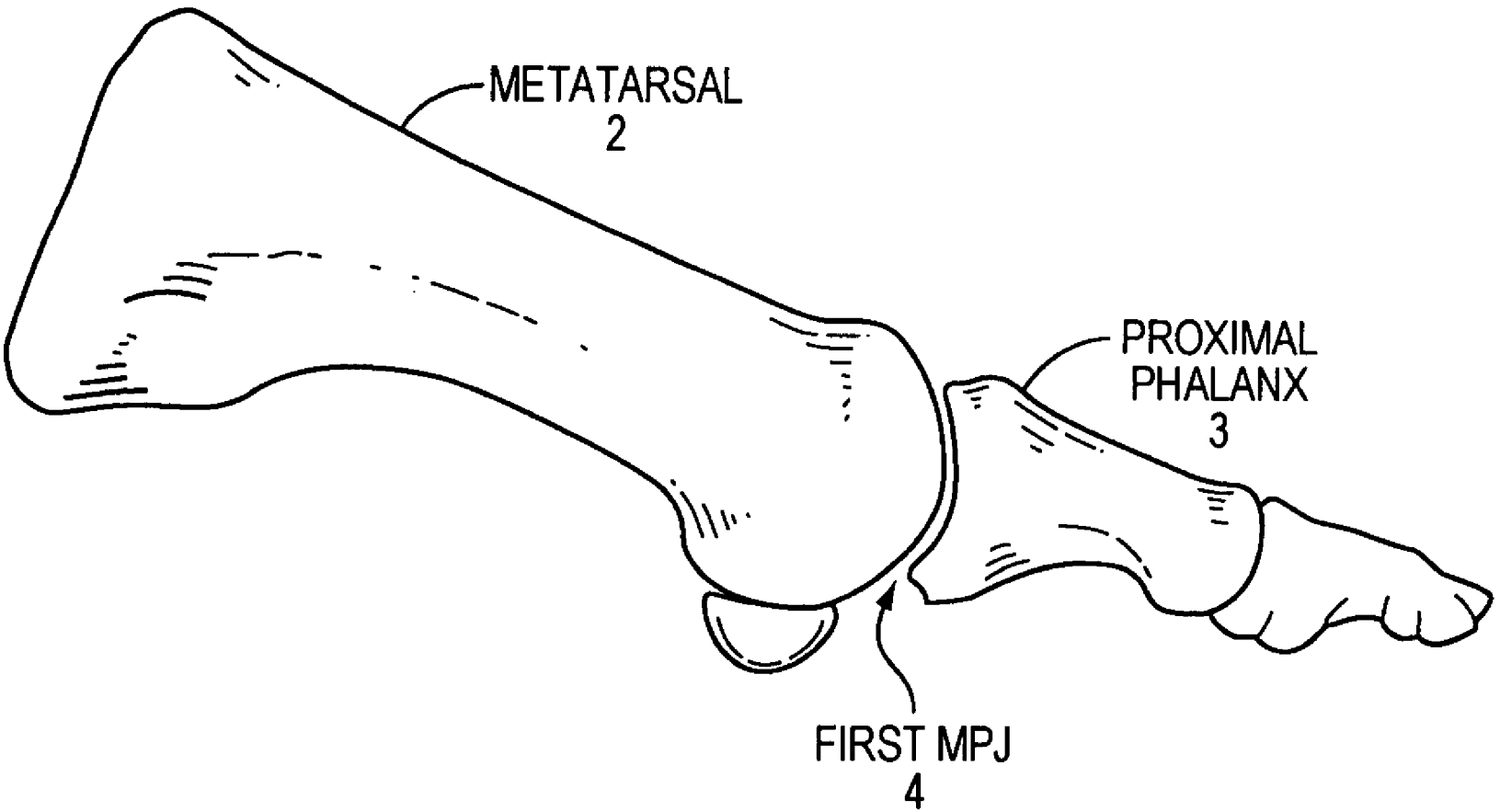
FIG. 1 is a schematic drawing illustrating the some of the bones in a typical foot.

Referring to FIG. 1, the proximal phalanx of the "big toe" or hallux is joined to a metatarsal bone of the foot at the first metatarsophalangeal joint. This joint allows the hallux to articulate in both dorsiflexion and plantarflexion. Generally, the proximal phalanx glides along the end surface of the metatarsal.

Figure 2:
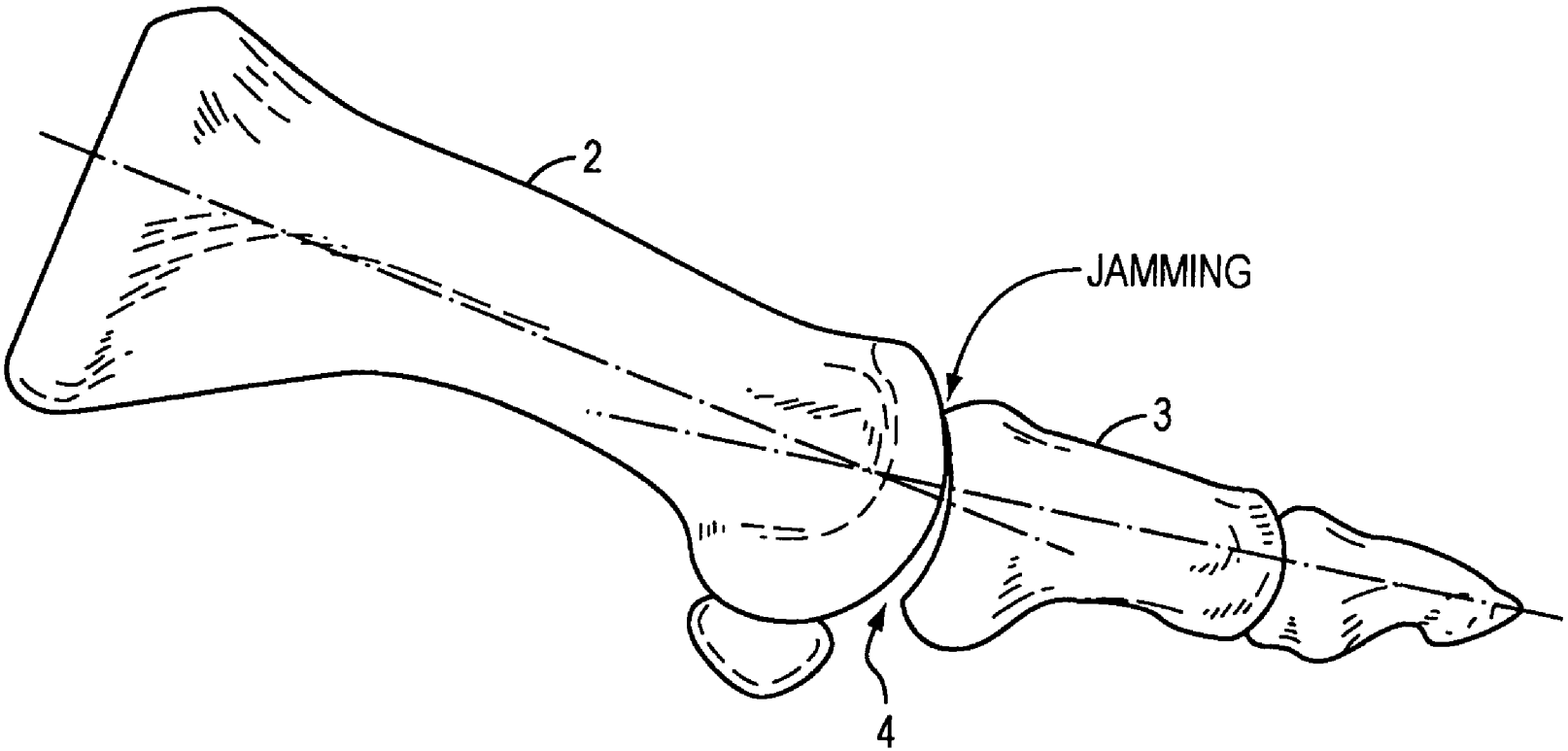
FIG. 2 is a schematic drawing illustrating the interaction of the metatarsal and the proximal phalanx using known therapeutic devices.

In prior physical therapy methods, the metatarsal is held stationary and the big toe is moved into dorsiflexion (i.e. upward towards the top of the foot) in a hinge type motion. However, full range of motion is inhibited due to jamming of the proximal phalanx on the stationary metatarsal as generally shown in FIG. 2. Accordingly, physical therapy is less effective.

Figure 3:
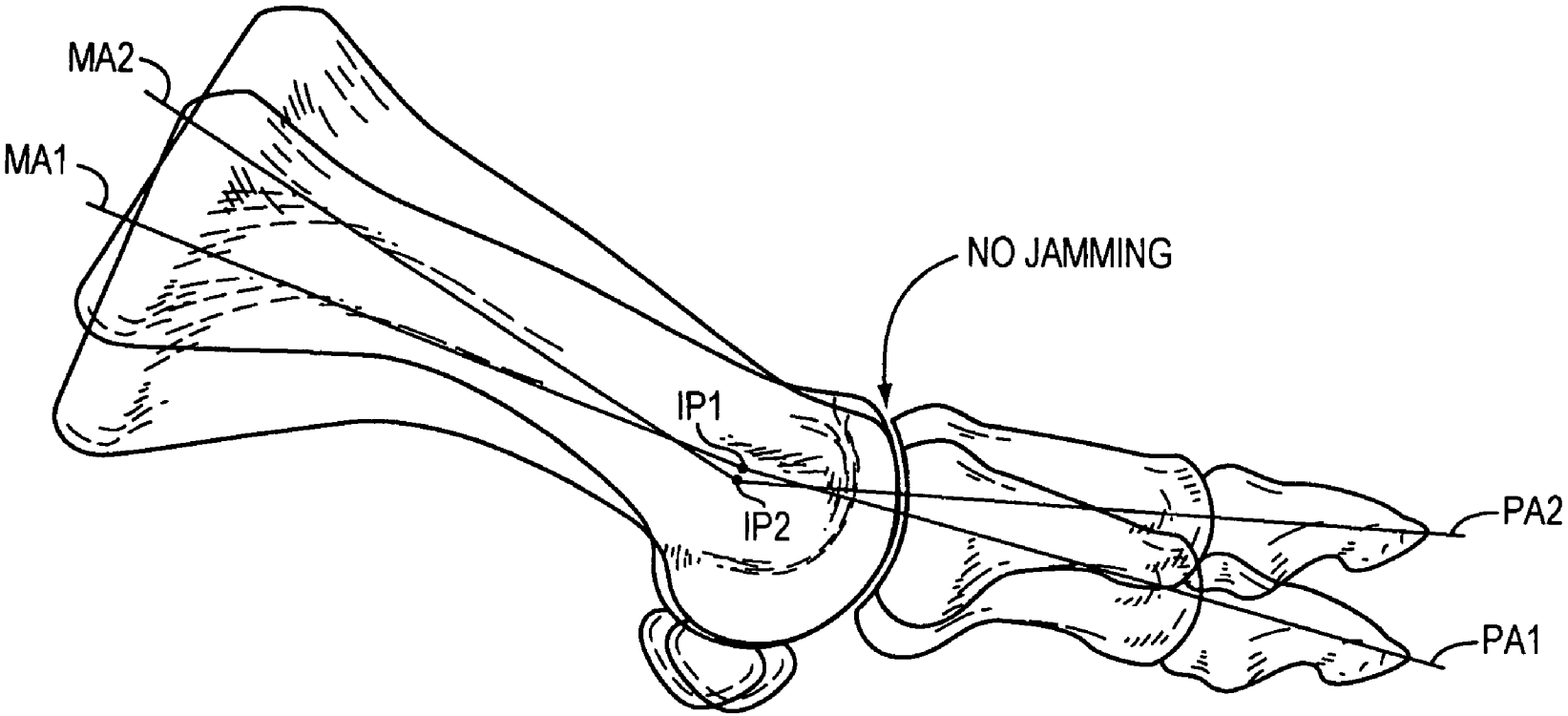
FIG. 3 is a schematic drawing illustrating the interaction of the metatarsal and the proximal phalanx when using an embodiment of the present invention.

In contrast, the natural motion of the proximal phalanx in relation to the metatarsal is a more complex gliding motion. More particularly, the longitudinal axes of the proximal phalanx and the metatarsal both move during flexion of the hallux as opposed to the metatarsal remaining stationary as provided with a hinged motion. This gliding movement is illustrated in FIG. 3. At a first position, the longitudinal axis of the metatarsal MA1 and the longitudinal axis of the proximal phalanx PA1 intersect at location IP1. During normal ambulation, the metatarsal axis moves to MA2 and the proximal phalanx axis moves to PA2 such that the intersection of the two axes is now at IP2. The movement of the intersection point allows greater range of motion of the hallux and prevents jamming as seen in prior art devices. As one of ordinary skill in the art will appreciate, the axes of both the metatarsal and the proximal phalanx will continue to move as ambulation continues.

Embodiments of the present invention provide a more effective treatment of the metatarsophalangeal joint by substantially reproducing the natural gliding motion of the hallux. In one embodiment, this gliding motion is accomplished by moving the metatarsal into plantarflexion while simultaneously moving the proximal phalanx in dorsiflexion as generally shown in FIG. 3. This action more closely reproduces the natural motion of the big toe during normal ambulation and allows increased range of motion. It should be understood that the plantarflexion of the metatarsal and the dorsiflexion of the proximal phalanx do not have to be simultaneous and could be asynchronous.

General Structure and Operation

Figure 4A:
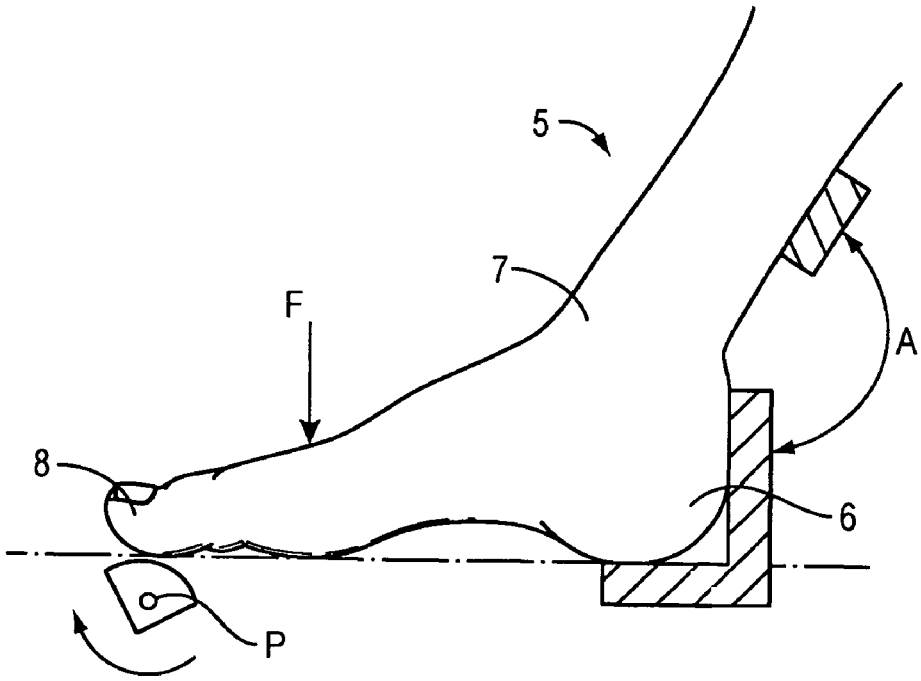
FIGS. 4A and 4B are schematic drawings of the "three point" bending concept as applied to manipulate a toe joint wherein a force is applied to the top of a user's foot in accordance with an embodiment of the present invention.

Referring to FIG. 4, an embodiment of the present invention is illustrated that utilizes a "three point" bending concept to cause flexion of the first metatarsophalangeal joint which is located at the base of the toe (herein after "toe joint"). More particularly, the metatarsal is moved into plantarflexion and the proximal phalanx is placed into dorsiflexion.

Figure 6:
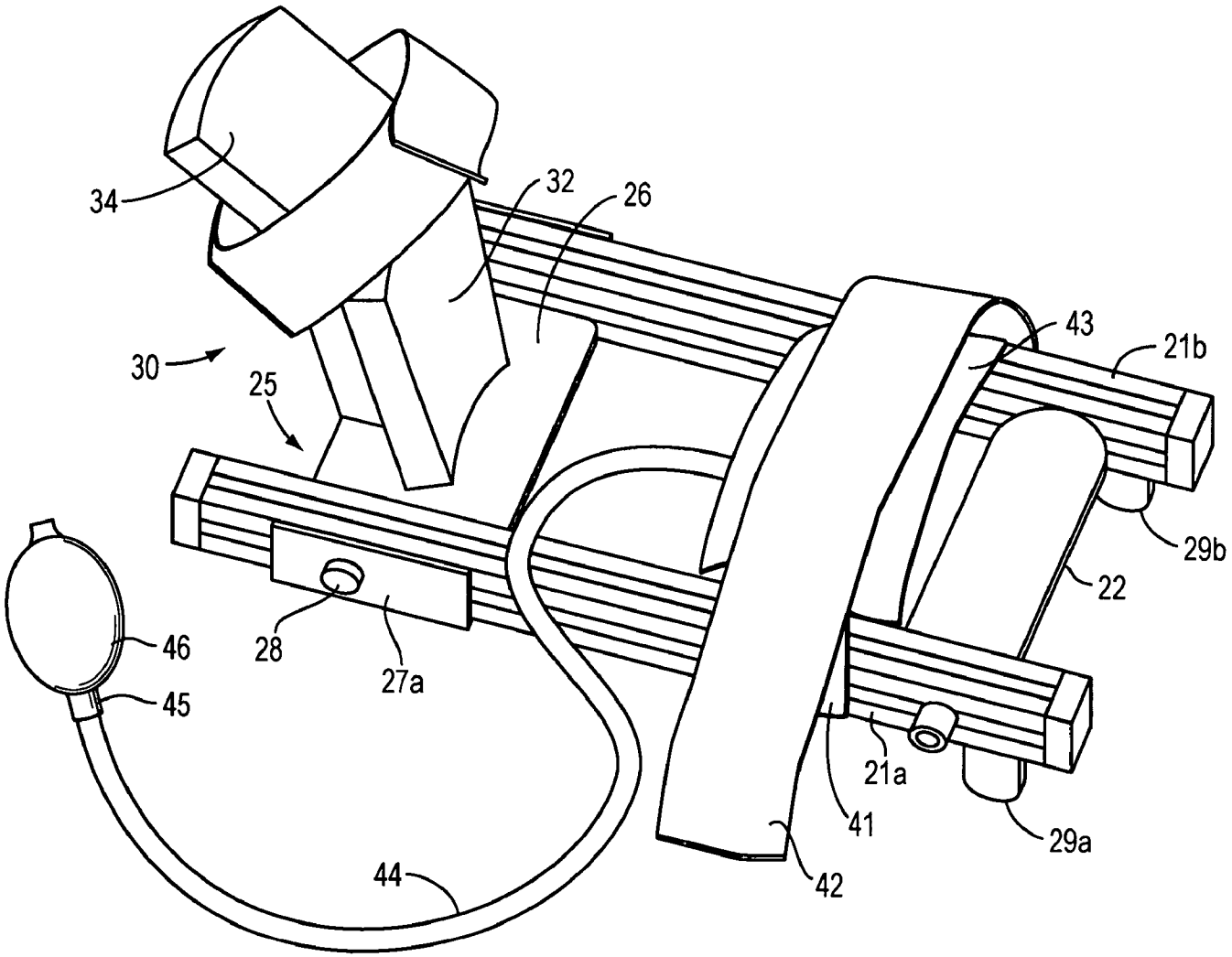
FIG. 6 is a drawing of an apparatus 10 illustrating the position of the straps when in use in accordance with an embodiment.

In the illustrated embodiment, a patient's foot 5 is positioned by supports at the low leg 7, the heel 6 and the toe 8. A force F is applied to the top of the foot causing the toe joint to articulate from a first position shown in FIG. 4*a* to a second position shown in FIG. 4*b*. In one embodiment, the force is applied using an inflatable bladder as shown in FIG. 6. The application of force in this manner allows the toe to glide arcuately without binding at the joint as is seen in the prior art therapeutic devices. One embodiment of the present invention substantially recreates the physiological motion experienced by the toe joint during normal ambulation.

One use of the device is to rehabilitate and restore the range of motion to the hallux or great toe. However, as one skilled in the art will recognize, the concepts described in this application may be applied to other toe joints either individually or in combination with the great toe or other joints as appropriate.

Figure 5:
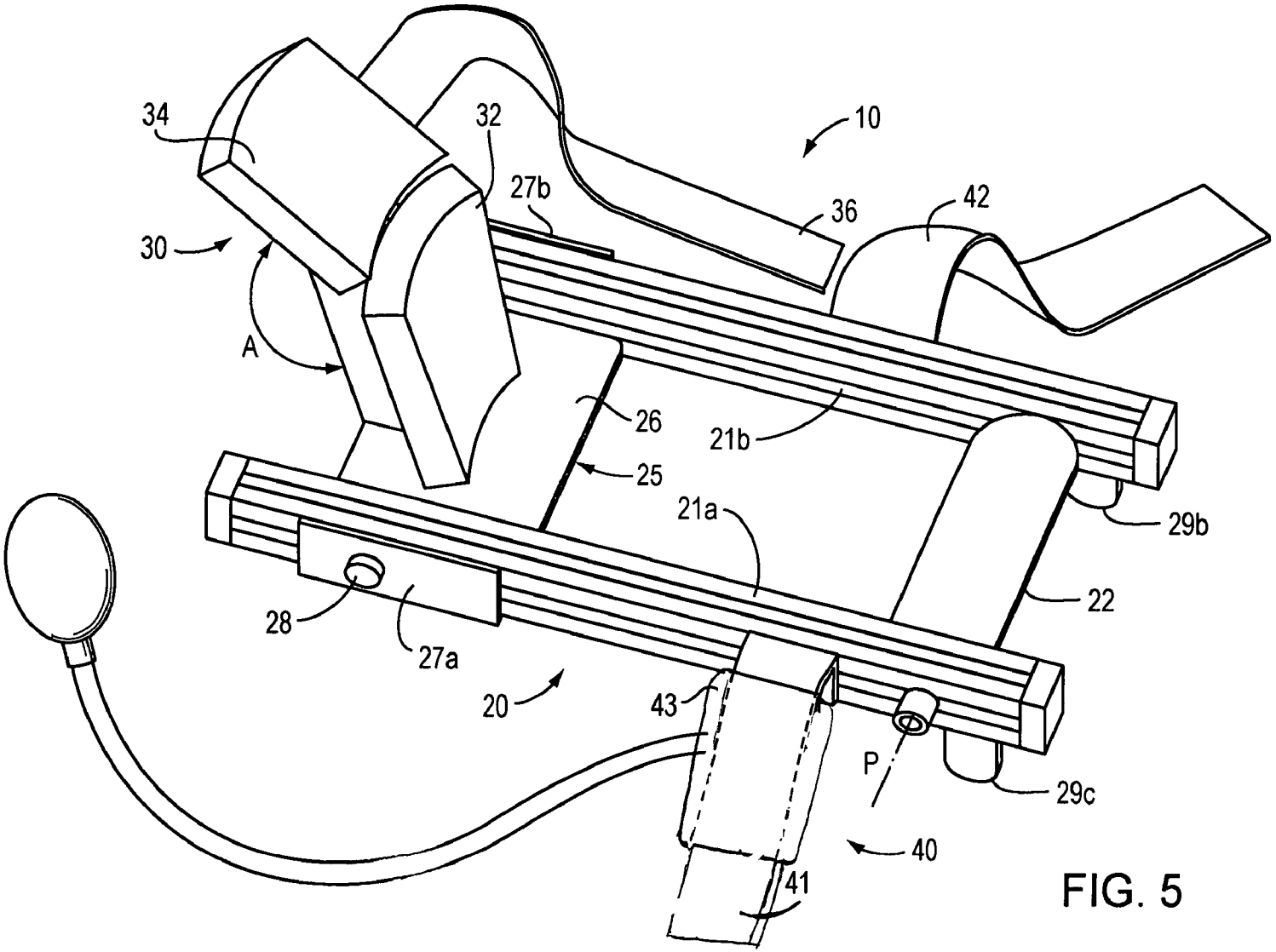
FIG. 5 is schematic drawing of an apparatus 10 in accordance with an embodiment of the present invention.

FIGS. 5-6 provide two views of a preferred embodiment of the toe manipulation device 10 of the present invention. Generally, this device includes an elongate frame 20, a leg harness 30 and an inflatable member 40. The elongate frame 20 is configured to support a user's foot at the heel and at the toe. The leg harness 30 places the ankle in plantar flexion such that tendons running along the back of the heel and the bottom of the foot are relaxed. In other words, the toe end of the foot is rotated downward such that greater range of motion of the toe joint is achieved due to reduced influence from attached tendons. Preferably, the foot is rotated downward approximately twenty-five degrees. This position allows the treatment to be focused on the desired toe joint. The inflatable member 40 works in conjunction with the elongate frame to concentrate a downward force to the top of the foot positioned in the device.

Elongate Frame Assembly 20

The elongate frame assembly 20 comprises two substantially parallel frame rails 21*a,b* connected at one end by a toe bar 22 and at the other end by a heel plate 25. The toe bar 22 is an elongate quarter round member fastened to the parallel frame rails 21*a,b* such that the toe bar 22 can rotate about its elongate axis P. This feature minimizes the shear force between the toe and the toe bar 22 during operation which reduces the chance of blisters forming on the toe. The toe bar 22 is preferably covered with a textured pad or other appropriate element to reduce the possibility of slippage between the toe and the toe bar 22. As one skilled in the art will appreciate, the toe bar 22 may be of any desired cross section, such as oval, triangular, or octagonal.

The heel plate 25 comprises a planar portion 26 with two flanges 27, which provide a means to slideably connect the heel plate 25 to the elongate rails 21*a,b*. The heel plate 25 may slide along a portion of the length of the frame rails to provide adjustments for different foot lengths and may be locked in place by tightening fasteners 28. The planar portion 26 is preferably padded for added comfort when in use.

Figure 7:
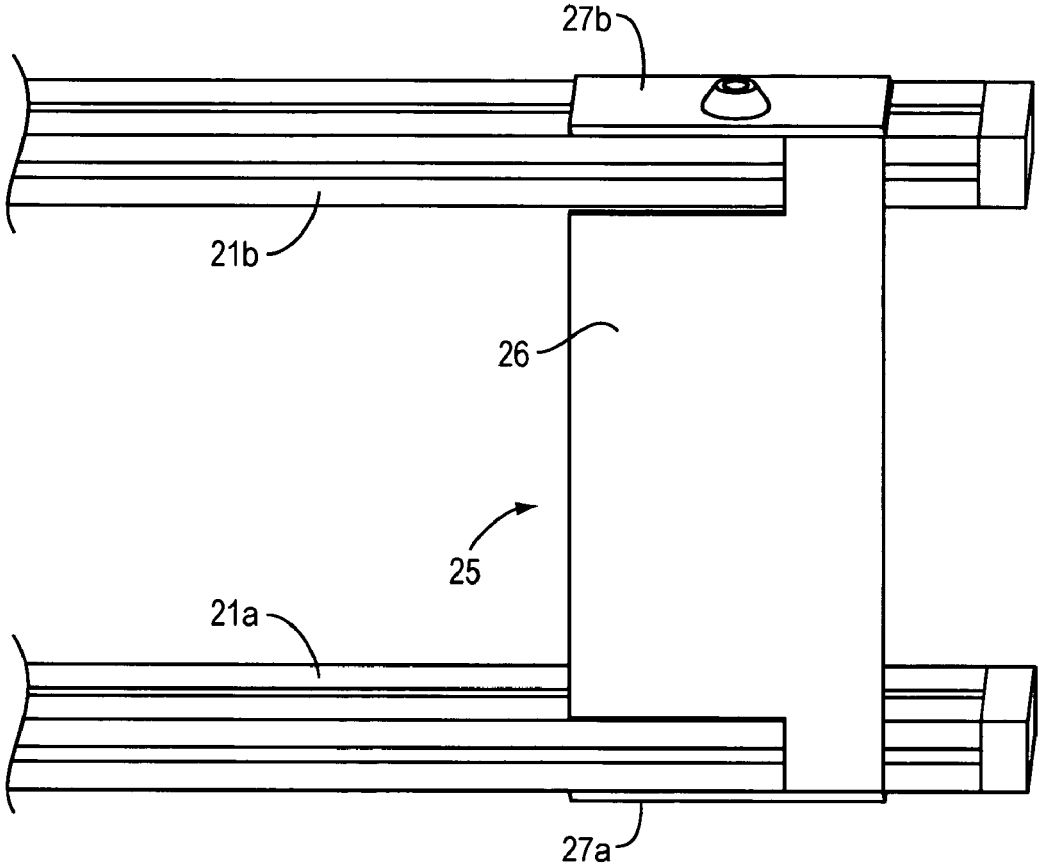
FIG. 7 is a drawing illustrating an alternative heel plate configured to allow pivoting of the leg harness and heel plate in accordance with an embodiment of the present invention.
Figure 8:
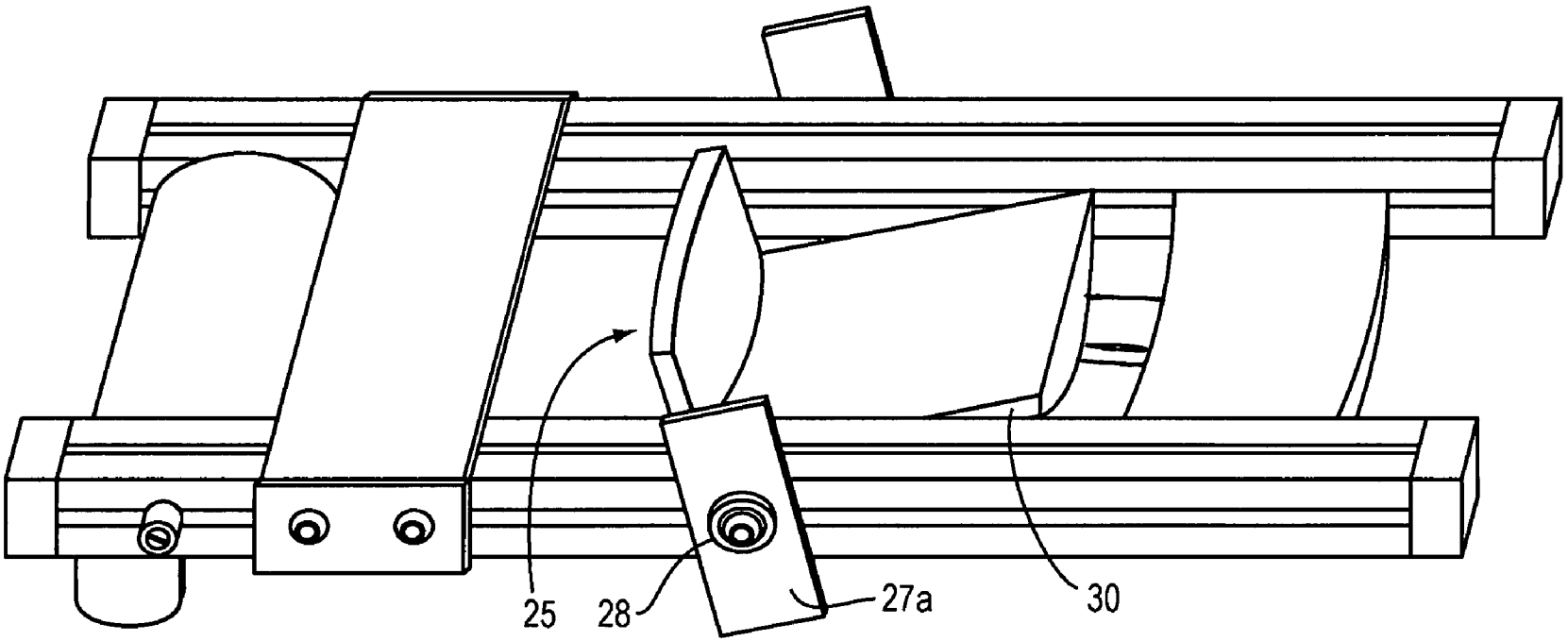
FIG. 8 is a drawing depicting the embodiment shown in FIG. 7 with the leg harness and heel plate in a pivoted condition.

In an alternative embodiment shown in FIGS. 7 and 8, the planar portion 26 of the heel plate 25 is substantially "T" shaped. This shape allows the heel plate 25 and leg harness 30 to pivot when the fasteners 28 are loosened as shown in FIG. 8. This pivoting feature reduces the overall profile of the device when not in use thereby making it easier to store. In preparation for use, the heel plate 25 is rotated until the planar portion 26 contacts the bottom of the frame rails 21*a,b* and the fasteners 28 are tightened shown in FIG. 7. This embodiment of the heel plate 25 retains the ability to slide along the frame rails to accommodate different foot lengths.

The elongate frame 20 also includes two risers 29 attached to the lower surface of the frame rails 21*a,b*. These risers elevate the toe portion of the device 10 to provide sufficient clearance between the top of the toe bar 22 and the support surface such that when a patient's toe joint is flexed, the foot does not contact the support surface. The risers 29 are preferably constructed of a non-skid type material such as rubber to reduce the chance of the device 10 sliding on the support surface during use. In alternative embodiments, the device 10 may have four risers (one at each end of the two frame rails). As one skilled in the art will appreciate, the clearance and non-skid functions of the risers may be achieved by increasing the thickness of the rails and applying a non-skid material directly to the bottom of the rails 21*a,b*.

Leg Harness 30

Returning to FIGS. 5 and 6, the leg harness 30 extends substantially perpendicular from the heel plate 25 and includes an upper heel support 32, a lower leg support 34 and a retaining strap 36. The heel plate 25, the upper heel support 32 and the lower leg support 34 may be integrally formed as shown in FIGS. 5 and 6, or constructed of separate members fastened together. In operation, the leg harness 30 slides with the heel plate 25 along a portion of the frame rails 21*a,b* to provide adjustments for different foot lengths.

The upper heel support 32 is a generally "U" shaped member extending up substantially perpendicular to the heel plate 25. The heel support 32 is configured to cradle the back portion of a user's heel and is preferably padded for comfort.

The lower leg support 34 extends upwardly from the lower heel support at an angle "A" as best seen in FIG. 4. Angle "A" is preferably 155 degrees or smaller but may be any desired angle. This angle causes the tendons in the foot to relax which allows greater flexibility at the toe joint. This member is generally "U" shaped and configured to cradle the lower portion of a user's leg (i.e. just above the ankle) and may be padded for comfort. A retaining strap 36 retains the user's lower leg in the lower leg support 34. The retention strap is secured to the lower leg support 34 at one end and has a hook and loop type fastener at the other end (such as VELCRO). This type of fastener allows the strap to be adjusted for different patients. As one of ordinary skill in the art will appreciate, the retention strap may be secured using any type of fastener such as friction or other buckle types.

Inflatable Bladder Assembly 40

Figure 4B:
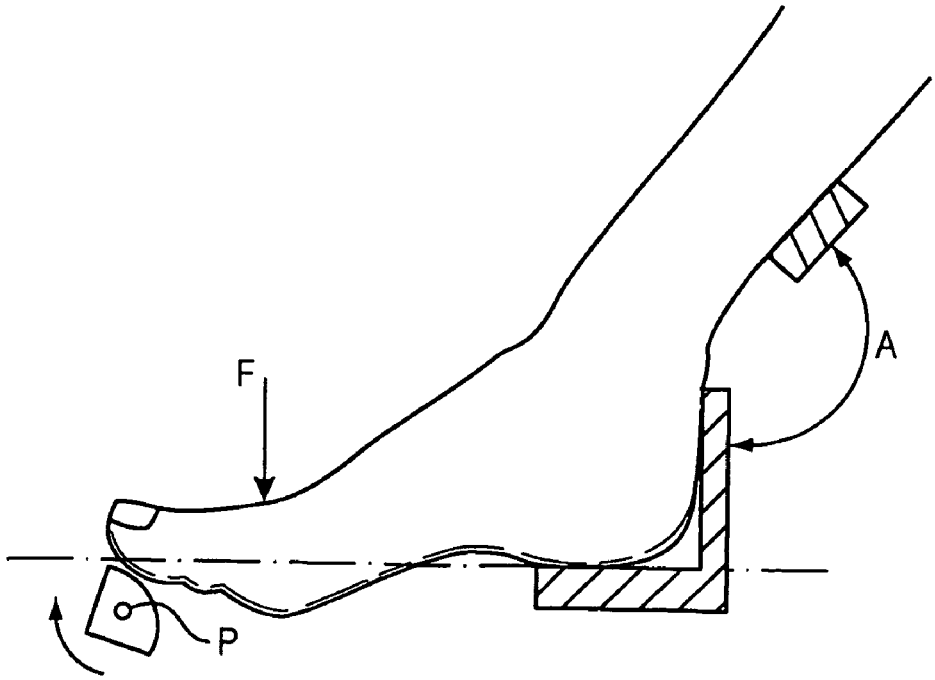

Working in conjunction with the elongate frame 20, an inflatable bladder assembly 40 provides a downward force to the top of a user's foot causing the toe joint to articulate as shown in FIG. 4B.

As shown in FIGS. 5 and 6, the inflatable bladder assembly 40 includes two straps 41, 42, an inflatable bladder 43, a hose 44, a release valve 45 and a bulb 46 for inflating the bladder.

Strap 41 is attached to frame rail 21*a* at one end and attached to the inflatable bladder proximate the other end using a hook and loop type fastener. This type of fastening allows a user to remove the inflatable bladder 43 and repositioned it on strap 41 for different foot widths. Of course, any attachment technique may be used to secure the inflatable bladder 43 to strap 41 in conjunction with the present invention.

Strap 42 is attached at one end to frame rail 21*b*.

The straps 41, 42 are attached to the frame rail at a location such that when a user's foot is placed in the device 10, the inflatable bladder 43 is positioned on top of the user's foot proximate the toe joint at the base of the toe (metatarsophalangeal joint). After a patient's foot is positioned in the device, strap 42 is secured to strap 41 using a hook and loop type fastener thereby securing the inflatable bladder 43 in preparation for inflation. In other words, the inflatable bladder 43 is positioned between the top of the user's foot and the straps 41, 42. Once again, any type of fastener may be used to connect strap 41 and strap 42. As one of skill in the art will appreciate, the inflatable bladder assembly 40 may comprise a single strap with the inflatable bladder attach thereto wherein the strap is wrapped around the frame rails 21*a,b* or is otherwise secured to the frame rails 21*a,b*.

The inflatable bladder 43 is inflated using a bulb 46 and release valve 45 via hose It should be understood that any method of applying a force to the foot may be used in connection with the present invention such as the use of straps and pulleys, a linear actuated member utilizing a ratchet action, gears or hydraulic pressure to apply the force or placing physical weights on the foot.

Method of Use

One purpose of the device 10 is to provide rehabilitation of the toe joint such that range of motion of the joint is restored. This device may be used at home, or under the direct supervision of a medical professional.

In operation, a user is seated in a chair and the device is placed on a suitable support surface. Alternatively, the patient may be lying in a supine position with the device 10 with the heel end of the frame rails resting on a support structure. In either case, the user places a foot into the device 10 with the heel cradled by the heel plate 25 and the upper heel support 32.

The great toe is supported by the toe bar 22 proximate the second toe joint which is located near the midpoint of the toe. Typically, at least some of the lesser toes on the foot receiving treatment are also supported by the toe bar 22.

The retention strap 36 is tightened to secure the user's lower leg to the device thereby creating an angle "A" shown in FIG. 1. This angle in one embodiment is preferably 155 degrees or smaller thereby relaxing the tendons in the foot allowing greater flexibility at the toe joint.

The inflatable bladder 43 is positioned atop the foot and secured to strap 41 using a hook and loop fastener. Strap 42 is releaseably attached to strap 41 thereby securing the inflatable bladder over the top of the user's foot. The inflatable bladder 43 is now positioned between the user's foot and the straps 41,42. At this point, the user is ready to initiate therapy.

Force is applied to the top of the foot by inflating the bladder 43 using bulb 46. As the bladder is inflated, the straps 41 and 42 increase in tension and a resulting force is applied to the top of the foot causing plantarflexion of the metatarsal. The big toe is support by the toe bar 22 and acts in dorsiflexion in response to the applied force as generally illustrated in FIG. 3. Typically, the bladder 43 is inflated until the user feels pain. At which point, the user may decrease the pressure using the release valve 45 as desired. This process is then repeated.

ALTERNATIVE EMBODIMENTS

Figure 9A:
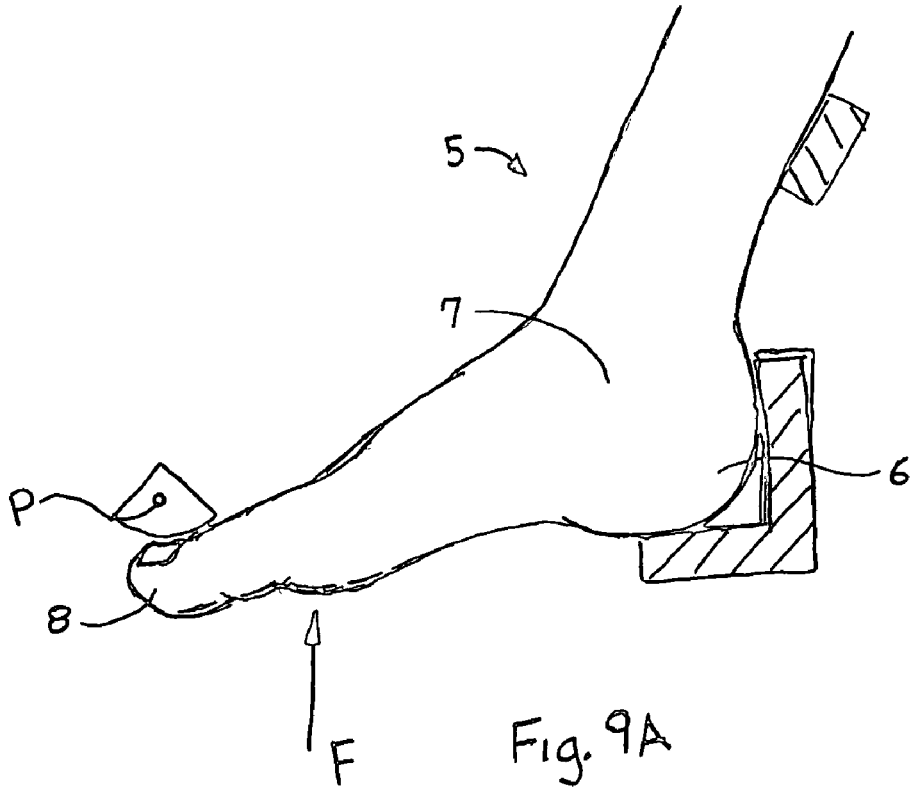
FIGS. 9A and 9B are schematic drawing of the three point bending concept wherein a force is applied from underneath the foot in accordance with an embodiment of the present invention.
Figure 9B:
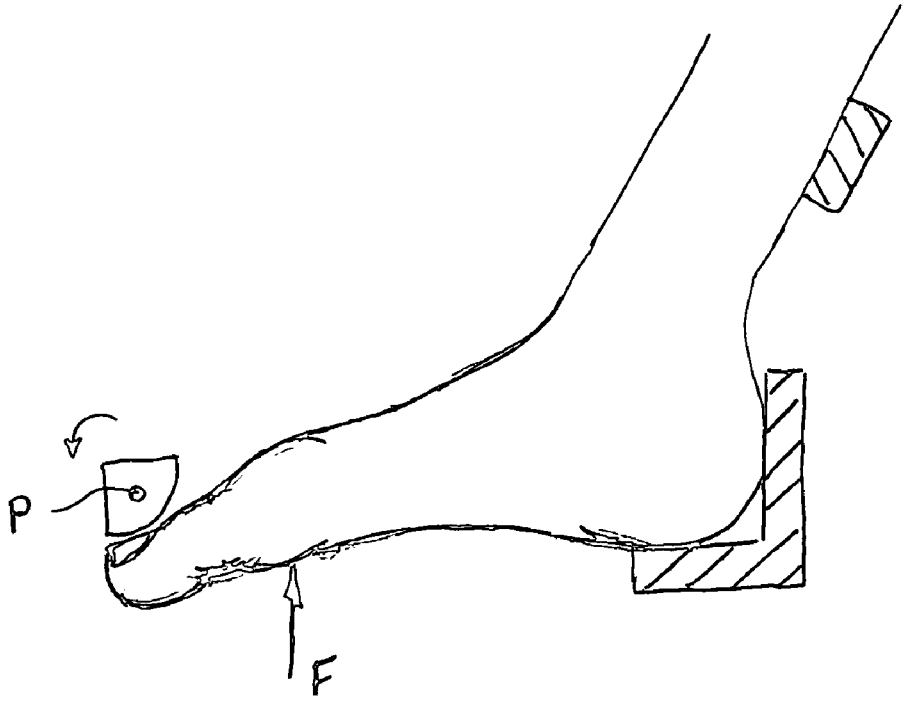

In addition to moving a toe in dorsiflexion, further embodiments of the present invention may be used to move a toe in plantarflexion. FIGS. 9A and 9B illustrate an embodiment of the present invention where the heel of a user is contained and the user's hallux is positioned underneath a toe bar. As a force is applied to the underside of the foot proximate the metatarsophalangeal joint, the toe is urged against a toe bar and as a result moves in plantarflexion. Simultaneously, the foot (or metatarsal) moves in dorsiflexion as illustrated in FIG. 9B.

Figure 10:
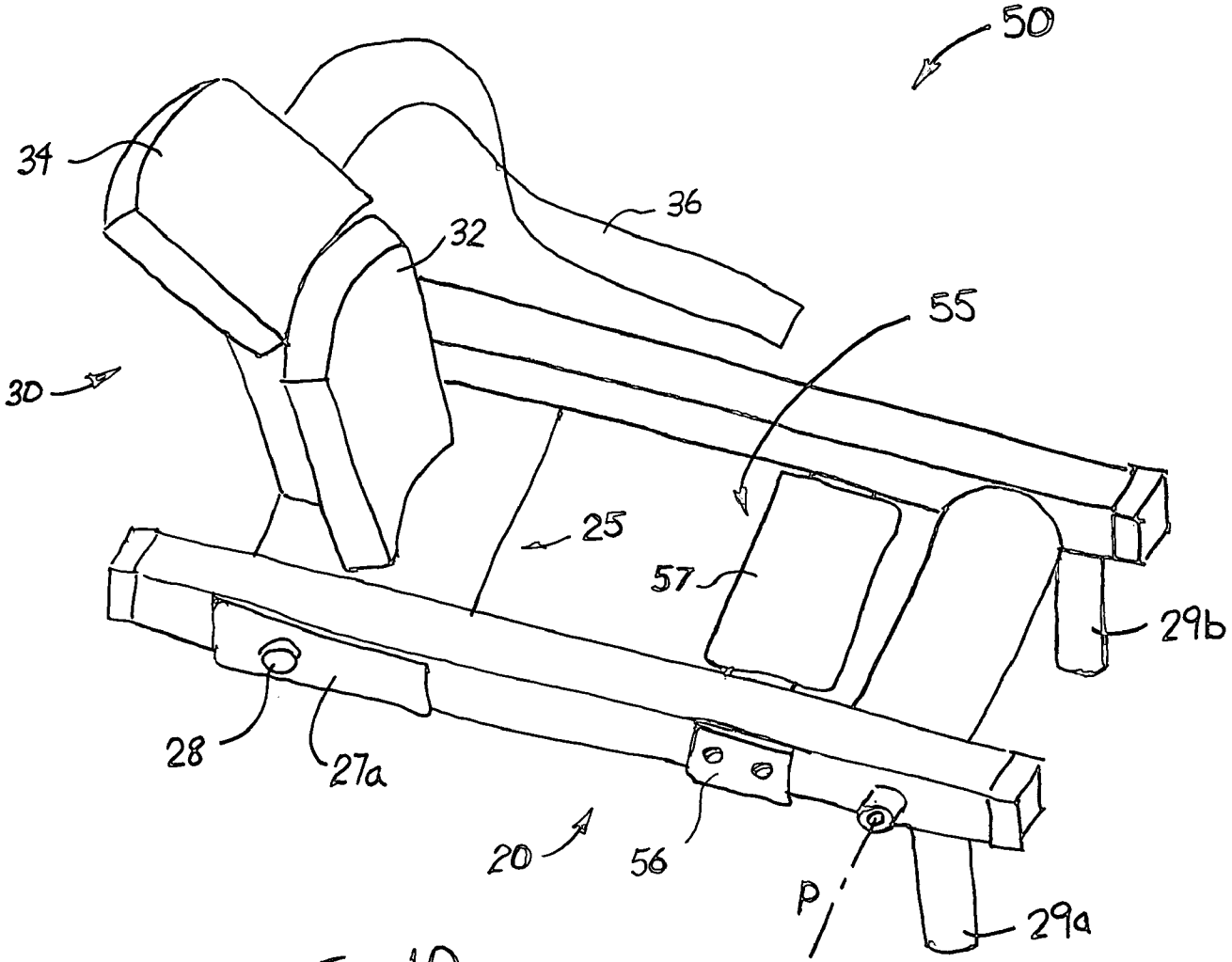
FIG. 10 is a schematic drawing of an alternative embodiment of the present invention configured to apply a force beneath a user's foot.

In FIG. 10, a toe manipulation device 50 is shown which is configured to move a toe of a user in plantarflexion. Toe manipulation device 50 includes an elongate frame 20 and a leg harness 30 as generally described with reference to the toe manipulation device 10. However, an inflatable assembly 55 is positioned beneath the user's foot in the present embodiment as opposed to the top of the foot as generally described with reference to the toe manipulation device 10. The inflatable assembly 55 includes a strap 56 connected to the frame assembly 20 and an inflatable member 57 connected to the strap. Alternatively, the inflatable member 57 may be positioned beneath the foot by a rigid member attached relative to the frame assembly 20 as opposed to a strap.

In use, the inflatable member 57 is positioned intermediate the bottom of the user's foot and the strap 56 (or rigid member). As the inflatable member 57 is inflated, the strap 56 increases in tension urging the foot upward. Movement of the toe is restricted by the toe bar and as a result the metatarsophalangeal joint is articulated with the foot moving in dorsiflexion and the toe moving in plantarflexion as generally illustrated in FIG. 9B. It should be understood that any method of applying a force to the foot may be used in connection with the present invention such as a mechanical or hydraulic device. For example, a hydraulic cylinder may be used to apply a force to the top of said foot.

CONCLUSION

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

The invention claimed is:

1. A method of manipulating a toe joint of a user having a lower leg, an ankle, a foot, a heel and a plurality of toes, said method comprising the steps of:

providing a frame assembly comprising a pair of elongate rails spaced apart and substantially parallel and connected proximate a first end by a toe bar having a width at least as wide as two of said plurality of toes;

positioning at least a part of a user's foot intermediate said pair of elongate rails with at least said two of said plurality of toes positioned atop said toe bar;

positioning an inflatable member atop said foot intermediate said plurality of toes and said ankle;

securing said inflatable member to said frame assembly using a strap such that said inflatable member is intermediate said foot and said strap; and inflating said inflatable member such that said strap increases in tension thereby urging at least one of said two toes against said toe bar causing said foot to move in plantarflexion relative to said frame assembly and said at least one of said two toes to move in dorsiflexion.

2. The method of claim 1 further comprising the step of providing a heel plate intermediate said parallel rails configured to support said heel.

3. The method of claim 2 further comprising the steps of:

providing a lower leg support configured to accept the lower leg of a user; and securing said lower leg to said lower leg support using a strap such that said foot is maintained in a planterflexed state even prior to further plantarflexion by said inflatable member.

4. A method of manipulating a toe joint of a user, said user having a lower leg, an ankle, an elongate foot having a longitudinal axis, a heel having an undersurface portion, and at least one toe having an undersurface portion, said method comprising the steps of:

A) providing a frame assembly configured to support said undersurface portion of said heel, configured to support said undersurface portion of said toe, and configured to support a portion of said lower leg;

B) positioning said user's foot such that said longitudinal axis of said foot is substantially coplanar with said elongate axis of said frame assembly;

C) securing said frame assembly to said foot with an attachment device such that one portion of said frame assembly is biased against said undersurface portion of said heel and another portion of said frame assembly is biased against said portion of said lower leg, such that said foot is maintained in a plantarflexed state; and D) providing a force atop said foot at a location intermediate said toe and said heel by providing an inflatable member attached relative to said frame assembly and inflating said inflatable member such that said force applied atop said foot is at least partially transferred through said frame assembly such that a counteracting force is provided against said toe and heel undersurface portions, providing a "three-point" force relationship, and so as to cause said toe undersurface portion to bias against said frame assembly, causing said toe to move in dorsiflexion and said foot to move in further plantarflexion relative to said frame assembly while said attachment device is in place.

5. The method as claimed in claim 4, wherein step "D" further comprises providing said inflatable member attached relative to said frame assembly by a flexible strap, and wherein said force atop said foot is provided by inflating said inflatable member such that said force applied atop said foot is at least partially transferred through said strap and said frame assembly such that a counteracting force is provided against said toe and heel undersurface portions, providing a "three-point" force relationship causing said toe to move in dorsiflexion and said foot to move in plantarflexion while said attachment device is in place.

6. A method of manipulating a toe joint of a user in two different directions, said user having a lower leg, an ankle, an elongate foot having a longitudinal axis, a heel having an undersurface portion, and at least one toe having a top surface portion and an opposing undersurface portion, said method comprising the steps of:

A) providing a frame assembly configured to support said undersurface portion of said toe when in a first foot position and to support said top surface portion of said toe when in a second foot position, said frame assembly configured to support said undersurface portion of said heel when in either said of said first or second foot positions;

B) positioning said user's foot in said first foot position such that said longitudinal axis of said foot is substantially coplanar with said elongate axis of said frame assembly, and said heel undersurface portion and said toe undersurface portions are both in contact with said frame assembly;

C) providing a force atop said foot at a location intermediate said toe and said heel so as to cause both heel undersurface portion and said toe undersurface portion to bias against said frame assembly, causing said foot to move in plantarflexion relative to said frame assembly_and said toe to move in dorsiflexion;

D) removing said force in step "C";

E) positioning said user's foot in said second foot position such that said longitudinal axis of said foot is substantially coplanar with said elongate axis of said frame assembly, and said heel undersurface portion and said toe undersurface portions are both in contact with said frame assembly;

F) attaching said foot relative to said frame assembly such that at least said heel undersurface portion tends to be biased into contact with said frame assembly; and G) providing a force underneath said foot at a location intermediate said toe and said heel so as to cause said toe top surface portion to bias against said frame assembly while said attachment in step "F" is maintained, causing said toe to move in plantarflexion and said foot to move in dorsiflexion relative to said frame assembly.

7. The method as claimed in claim 6, wherein said step "B" further comprises securing said frame assembly to said foot such that one portion of said frame assembly is biased against said undersurface portion of said heel and another portion of said frame assembly is biased against said portion of said lower leg, such that said foot is maintained in a plantarflexed state even prior to further plantarflexion in step "C"; and wherein in said step "F" said attachment of said foot relative to said frame assembly comprises securing said frame assembly to said foot such that said one portion of said frame assembly is biased against said undersurface portion of said heel and another portion of said frame assembly is biased against said portion of said lower leg, such that said foot is maintained in a plantarflexed state prior to the dorsiflexion in step "G".

8. An apparatus for manipulating a toe joint of a user having a lower leg, an ankle, an elongate foot having a longitudinal axis, a heel and a plurality of toes, said apparatus comprising:

an elongate frame assembly including an elongate axis and itself including a heel plate and a toe bar, said heel plate configured to support said heel and said toe bar configured to support at least one of said plurality of toes such that said longitudinal axis of said foot is substantially coplanar with said elongate axis of said frame assembly;

an inflatable member attached relative to said frame assembly configured to be positioned against the top of said foot and to provide an increasing force against said foot for a given range of inflation; and wherein said inflatable member is positioned atop said foot such that a portion of said inflatable member is positioned against said foot at a location intermediate said toe and said heel such that when said inflatable member is sufficiently inflated, said inflatable member pushes against the top of said foot, urging said toe against said toe bar thereby causing said foot to move in plantarflexion relative to said frame assembly and said toe to move in dorsiflexion.

9. An apparatus for manipulating a toe joint of a user having a lower leg, an ankle, an elongate foot having a longitudinal axis, a heel and a plurality of toes, said apparatus comprising:

an elongate frame assembly including an elongate axis and itself including a heel plate and a toe bar, said heel plate configured to support said heel and said toe bar configured to support at least one of said plurality of toes such that said longitudinal axis of said foot is substantially coplanar with said elongate axis of said frame assembly;

a strap attached relative to said frame assembly;

an inflatable member attached to said strap; and wherein said strap is configured to position said inflatable member atop said foot such that a portion of said inflatable member is positioned against said foot at a location intermediate said toe and said heel such that when said inflatable member is sufficiently inflated, said inflatable member pushes against the top of said foot and said strap increases in tension urging said toe against said toe bar thereby causing said foot to move in plantarflexion relative to said frame assembly and said toe to move in dorsiflexion.

10. The apparatus of claim 9, wherein said toe support portion is pivotably attached to said frame assembly such that said toe bar rotates in response to said at least one toe moving into dorsiflexion.

11. The apparatus of claim 9, wherein said toe bar includes an arcuate portion for providing support to said toe.

12. The apparatus of claim 9, wherein said heel plate and said toe bar are both elongate and have longitudinal axes each being substantially perpendicular to said elongate axis of said frame assembly.

13. The apparatus of claim 9, further comprising an upper heel support attached relative to said heel plate and configured to restrict movement of said heel in at least one direction substantially parallel to said elongate axis of said elongate frame assembly.

14. The apparatus of claim 13, further comprising a lower leg support attached relative to said upper heel support, said lower leg support configured to cooperate with said upper heel support to position said ankle at a predetermined downward angle such that said foot is maintained in a plantarflexed state even prior to further plantarflexion by said inflatable member.

15. The apparatus of claim 14, further comprising a lower leg retention member, separate from said strap, to retain said lower leg relative to said lower leg support while said strap is in tension.

16. The apparatus of claim 15, wherein said strap is a first strap, and wherein said lower leg retention member is a second strap configured to attach to said lower leg of said user relative to said lower leg support, said second strap to retain said lower leg relative to said lower leg support while said first strap is in tension.

17. The apparatus of claim 9 wherein said heel plate is adjustable relative to the elongate axis of said frame assembly to accommodate differing foot lengths.

18. An apparatus for manipulating a toe joint of a user having a lower leg, an ankle, a foot, a heel and a plurality of toes, said apparatus comprising:

a frame assembly comprising a first frame rail and a second frame rail spaced apart and substantially parallel to said first frame rail, said frame assembly having a first end and a second end;

a toe support bar pivotably attached to said first and said second frame rails proximate said first end of said frame assembly;

a strap attached relative to at least one of said first and second frame rails of said frame assembly, said strap being attached intermediate said toe bar and said second end of said frame assembly; and an inflatable member attached to said strap;

wherein said strap is configured to position said inflatable member atop said foot such that when said inflatable member is sufficiently inflated, said strap increases in tension urging said toe against said toe bar, thereby causing said foot to move in plantarflexion relative to said frame assembly and said toe to move in dorsiflexion.

19. The apparatus of claim 18, further comprising a heel plate releaseably secured relative to said first and said second frame rails intermediate said toe support bar and said second end of said frame assembly such that said heel plate is adjustable relative to said elongate axis of said first and said second frame rails to accommodate differing foot lengths, said heel plate configured to support said heel.

20. The apparatus of claim 19, further comprising an upper heel support attached relative to said heel plate and configured to restrict movement of said heel in at least one direction along an axis parallel to said elongate axis of said elongate frame assembly.

21. The apparatus of claim 20, further comprising a lower leg support attached relative to said upper heel support and configured to accept said lower leg of said user and resist movement of said lower leg relative to said frame assembly.

22. The apparatus of claim 21, wherein said lower leg support, said heel plate and said upper heel support are configured to cooperatively position said ankle at a predetermined downward angle such that said foot is maintained in a plantarflexed state even prior to further plantarflexion by said inflatable member.

23. The apparatus of claim 18, wherein said toe support bar has an arcuate portion.

24. The apparatus of claim 18, wherein said heel plate and said toe bar are both elongate and have longitudinal axes each being substantially perpendicular to said elongate axis of said frame assembly.

25. An apparatus for manipulating a toe joint of a user having a lower leg, an ankle, a heel, an elongate foot having a longitudinal axis, and a plurality of toes, said apparatus comprising:

a heel containment device configured to restrict movement of said heel in at least one direction along an axis parallel to said longitudinal axis of said foot and in at least one direction along an axis parallel to the longitudinal axis of said leg;

a pivoting toe bar having a width at least as wide as two of said plurality of toes, said pivoting toe bar attached relative to said heel containment device and configured to contact at least two of said plurality of toes; and a force application device comprising a strap attached relative to said frame and further comprising an inflatable member configured to be positioned intermediate said strap and said foot of said user wherein said strap increases in tension when said inflatable member is sufficiently inflated, said force application device configured to apply a force to said foot intermediate said heel and said plurality of toes in an axis substantially perpendicular to the longitudinal axis of said foot such that when said force is applied resulting from the inflation of said inflatable member, said foot flexes relative to said heel containment device of said apparatus and said at least one of said two toes is urged toward said toe bar urging actuation of a joint intermediate said at least one toe and said foot.

26. The apparatus of claim 25, further comprising a lower leg support configured to accept the lower leg of a user and in cooperation with said heel containment device to position said ankle such that said foot is maintained in a plantarflexed state prior to actuation of said joint by said force application device.

27. The apparatus of claim 25, wherein said force application device is configured to apply said force atop said foot and wherein further said actuation of said joint comprises said at least one toe moving in dorsiflexion and said foot moving in said plantar flexion.

28. The apparatus of claim 25, wherein said force application device is configured to apply said force below said foot and wherein further said actuation of said joint comprises said at least one toe moving in plantarflexion and said foot moving in dorsiflexion.

29. An apparatus for manipulating a toe joint of a user having a lower leg, an ankle, a foot, a heel and a plurality of toes, said apparatus comprising:

a frame assembly comprising a first frame rail and a second frame rail spaced apart and substantially parallel to said first frame rail, said frame assembly having a first end and a second end;

a toe bar pivotably attached to said first and said second frame rails proximate said first end of said frame assembly and configured to be positioned on top of at least one of said plurality of toes; and an inflatable member attached relative to said frame intermediate said first and said second frame rails and also intermediate said toe support bar and said second end, said inflatable member configured upon sufficient inflation to urge said at least one toe against said toe bar thereby causing said foot to move in dorsiflexion relative to said frame assembly and said toe to move in plantarflexion.

30. The apparatus of claim 29, further comprising a heel plate releaseably secured relative to said first and said second frame rails intermediate said toe support bar and said second end of said frame assembly such that said heel plate is adjustable relative to said elongate axis of said first and said second frame rails to accommodate differing foot lengths, said heel plate configured to support said heel.

31. The apparatus of claim 30, further comprising an upper heel support attached relative to said heel plate and configured to restrict movement of said heel in at least one direction along an axis parallel to the longitudinal axes of said frame rails of said frame assembly.

32. The apparatus of claim 31, further comprising a lower leg support attached relative to said upper heel support and configured to accept said lower leg of said user and resist movement of said lower leg.

33. The apparatus of claim 32, wherein said lower leg support, said heel plate and said upper heel support are configured to cooperatively position said ankle at a predetermined downward angle such that said foot is maintained in a plantarflexed state even prior to further plantarflexion by said inflatable member.

34. The apparatus of claim 29, wherein said toe bar is elongate and has a longitudinal axis each being substantially perpendicular to said elongate axis of said frame assembly.

35. An apparatus for manipulating a toe joint of a user, said user having a lower leg, an ankle, an elongate foot having a longitudinal axis, a heel having an undersurface portion, and at least one toe having an undersurface portion, said apparatus comprising;

an elongate frame assembly including an elongate axis and itself including a heel undersurface support member and a toe support member, said heel undersurface support configured to support said heel via contact with said heel undersurface portion and said toe support configured to support said toe via contact with said toe undersurface portion such that said longitudinal axis of said foot is substantially coplanar with said elongate axis of said frame assembly;

an inflatable member capable of providing a force upon inflation;

a connecting device for connecting said inflatable member relative to said elongate frame assembly such that said inflatable member is placed atop said foot such that a portion of said inflatable member is positioned at a location intermediate said toe and said heel such that such that when said inflatable member is sufficiently inflated, said inflatable member provides said force against the top of said foot thus urging said toe undersurface portion against said toe support member and said heel undersurface portion against said heel undersurface support member thereby causing said foot to move in plantarflexion relative to said frame assembly and said toe to move in dorsiflexion; and a lower leg support member configured to provide support to said lower leg such that said ankle of said user is positioned at a predetermined angle such that said foot is maintained in a plantarflexed state even prior to further plantarflexion by inflation of said inflatable member.

36. The device as claimed in claim 35, wherein said lower leg is retained in place relative to said lower leg support member by a lower leg retention member.

37. The device as claimed in claim 36, wherein said lower leg support member is attached relative to said heel undersurface support and said lower leg support member and said heel undersurface support are adjustable at the same time along said elongate axis of said elongate frame assembly to accommodate differing foot lengths.

38. The device as claimed in claim 37, wherein an upper heel support is attached relative to said heel undersurface support and said upper heel support and said heel undersurface support are adjustable at the same time along said elongate axis of said elongate frame assembly to accommodate differing foot lengths.

39. The device as claimed in claim 36, wherein said lower leg retention member includes a flexible strap.

40. The device as claimed in claim 39, wherein said lower leg support member is attached relative to said heel undersurface support and said lower leg support member and said heel undersurface support are adjustable at the same time along said elongate axis of said elongate frame assembly to accommodate differing foot lengths.

41. The device as claimed in claim 40, wherein an upper heel support is attached relative to said heel undersurface support and said upper heel support and said heel undersurface support are adjustable at the same time along said elongate axis of said elongate frame assembly to accommodate differing foot lengths.

42. The device as claimed in claim 41, wherein said connecting device connecting said inflatable member relative to said elongate frame assembly includes a flexible strap.

43. The device as claimed in claim 35, wherein an upper heel support is attached relative to said heel undersurface support and said upper heel support and said heel undersurface support are adjustable at the same time along said elongate axis of said elongate frame assembly to accommodate differing foot lengths.

44. The device as claimed in claim 35, wherein said heel undersurface support member is a heel plate.

45. The device as claimed in claim 35, wherein said connecting device connecting said inflatable member relative to said elongate frame assembly includes a flexible strap.

* * * * *